US007752798B2

(12) United States Patent
Mayerle

(10) Patent No.: US 7,752,798 B2
(45) Date of Patent: Jul. 13, 2010

(54) SEE-THROUGH PERISCOPE FOR SIGHTING-IN OPTICAL OR OPEN SIGHTS ON A FIREARM

(76) Inventor: Ronald T. Mayerle, 1746 Juniper La. Southwest, Rochester, MN (US) 55902-1680

( * ) Notice: Subject to any disclaimer, the term of this patent is extended or adjusted under 35 U.S.C. 154(b) by 461 days.

(21) Appl. No.: 11/251,038

(22) Filed: Oct. 14, 2005

(65) Prior Publication Data

US 2008/0104875 A1 May 8, 2008

(51) Int. Cl.
*F41G 1/40* (2006.01)

(52) U.S. Cl. ..... 42/118

(58) Field of Classification Search ..... 42/118
See application file for complete search history.

(56) References Cited

U.S. PATENT DOCUMENTS 694,904 A * 3/1902 Youlten ..... 42/118
1,176,893 A * 3/1916 Hartney ..... 356/254
1,184,078 A * 5/1916 Cooke ..... 42/118
2,627,132 A * 2/1953 Dolgacius ..... 42/118
3,709,124 A 1/1973 Hunt
3,749,494 A * 7/1973 Hodges ..... 356/16
3,863,354 A 2/1975 Karppinen
4,275,639 A 6/1981 Garber
4,336,743 A 6/1982 Horn et al.
4,674,395 A 6/1987 Scheipner
4,878,305 A * 11/1989 Gabrielidis ..... 42/72
4,976,038 A 12/1990 Nattrass
5,060,554 A 10/1991 Aharon
5,084,780 A 1/1992 Phillips
5,140,151 A 8/1992 Weiner et al.
5,946,132 A 8/1999 Phillips
6,311,424 B1 * 11/2001 Burke ..... 42/118

(Continued)

OTHER PUBLICATIONS

The Maryland AR15 Shooters Site, Sights & Optics FAQ, pp.1-5, Jun. 13, 2005, TheMarylandAR15ShootersSite@groups.msn.org. USA.

(Continued)

*Primary Examiner*—Troy Chambers
(74) *Attorney, Agent, or Firm*—Ojanen Law Offices; Karuna Ojanen

(57) ABSTRACT

A see-through periscope for sighting-in optical sights or open sights by co-aligning one type of sighting system with the other type. The small see-through periscope is preferably used with firearms that have two conditions: (1) the rifle must be equipped with open sights, and (2) a gap must exist between the front of the optical sight and the rear open sight where the periscope can be mounted. Four unique mounts allow the periscope to be used with both magnifying or non-magnifying optical sights of different types, sizes, and shapes and open sights of different heights. The mounts position the bottom mirror at the height of the open sights and the top mirror at a point higher than the optical sight. The bottom mirror captures an image of the open sights aimed at a target and reflects that image to the top mirror, which in turn reflects the image across the top of the optical sight and into the eye of the shooter. The optical sight can still be used because the periscope mounted in front of it has no front or back panels, leaving a window for the shooter to see through the optical sight.

7 Claims, 12 Drawing Sheets

U.S. PATENT DOCUMENTS

| | | | |
|---|---|---|---|
| 6,336,283 | B1 | 1/2002 | Ortiz |
| 6,513,276 | B2 | 2/2003 | Mendoza-Orozco |

OTHER PUBLICATIONS

Modern Firearms Assault Rifles, Steyr Stg. 77 AUG assault rifle (Austria) , pp. 1-5, Aug. 18, 2003, http://world.gunds.ru/assault/as20-e.htm.

Dragon Series Generation 1 / 2 / 3 Night vision weapon sights. pp. 1-8, Aug. 18, 2003, http://x20.org/nightvision/dragon.htm.

Canfield, Bruce, Built for the Trenches: When American inventors turned their ingenuity to saving American lives in the horrific trenches of World War I, the Cameron-Yaggi Trench Periscope Rifle was one result, pp. 1-4, The National Rifle Association Publications, Jun. 8, 2003, http://www.nrahq.org/publications/tar/general3.asp USA.

Cabela's 2003 Shooting Catalog, pp. 130, 144-145. USA.

Optomechanical and Precision Instrucment Design p. 6-7, http://www.spie.org/web/oer/spetember/ep98/opidwg.html USA.

* cited by examiner

SEE-THROUGH PERISCOPE FOR SIGHTING-IN OPTICAL OR OPEN SIGHTS ON A FIREARM

FIELD OF THE INVENTION

This invention relates generally to the field of accurate sighting of a rifle or other firearm, and more specifically relates to an apparatus and method to sight in firearms by co-aligning the aimpoint of a first sighting system with the aimpoint of another sighting system and ensuring correct aimpoints.

BACKGROUND OF THE INVENTION

A large number of rifles, shotguns, muzzleloaders, military firearms, etc. were and are manufactured equipped only with open sights, also called iron sights. These rifles may be subsequently fitted with optical sights such as riflescopes, reflex, and holographic sights, but in order to be accurate, these optical sights must "zeroed in." A bullet fired from a rifle or other firearm that is zeroed in will strike a target at the aimpoint at a specific distance, given a good shooter and good shooting conditions. The process of zeroing a firearm is most commonly referred to as sighting-in. Unfortunately, current methods for sighting-in can be costly, imprecise, and/or require much time and ammunition.

One method for sighting-in involves mounting the optical sight on a rifle, and then centering the elevation and lateral aimpoint adjustment screws on the optical sight and test firing at a paper target (herein, the aimpoint on a target is assumed to be a bullseye at the center of the target). This method does not give the shooter a good idea of the flightpath of the bullet. Consequently, the test bullet may miss the target altogether, sometimes leaving the shooter with no idea where the bullet went.

In response, four aiming tools were developed to assist with the sighting-in process: (1) boresighting; (2) optical collimators; (3) laser devices; and (4) sight-to-sight co-alignment. These four aiming tools all work on the same principle: the optical sight is aimed at a point on a target determined by aiming with the bore or open sights of the firearm or at a point on a target that emanates from a laser or an optical collimator mounted on the firearm. The four aiming tools help ensure that a test bullet will hit somewhere on a paper target, known as getting "on paper," if not close to the aimpoint. Getting on paper gives a reference point for correcting the aimpoint of the optical sight. Each of these aiming tools will be examined in greater detail later.

Two aimpoint-correction methods can be used to correct the aimpoint of an optical sight: (1) measure-and-adjust; or (2) adjust-to-strikepoint. Both methods assume that an aiming tool was used to initially adjust the optical sight, and that a carefully fired test shot hit the target. Either method can then be used to move the optical sight's aimpoint until it corresponds with the strikepoint of the test bullet. To use the measure-and-adjust method, a shooter must know how turning the elevation and lateral adjustment screws on the optical sight will move the aimpoint of the optical sight at the distance to the target. For example, turning the elevation and lateral screws one click may move the aimpoint 0.25 inches at 25 yards. The shooter then measures the horizontal and vertical distances from the aimpoint to the bullet hole on the target. He/she then adjusts the elevation and lateral adjustment screws the appropriate number of clicks to remove the aiming error. The test firing and aimpoint-correction process may need to be repeated because the actual movement of the aimpoint per click of the elevation and lateral adjustment screws often differs from the manufacturer's specifications, especially with less expensive optical sights or when the adjustment mechanisms are near their limits of adjustment.

The other aimpoint-correction method, adjust-to-strikepoint, requires that the shooter be able to see the strikepoint of the test bullet with the optical sight from the shooting position. If not, an easy-to-see marker, such as a black disk, can be positioned over the strikepoint. Then, the shooter steadies the rifle using a rifle rest and/or sandbags and aims at the target with the aiming tool. The shooter then adjusts the optical sight so that it aims at the strikepoint of the test bullet while maintaining the aim of the aiming tool on the target. This adjust-to-strikepoint method adjusts the optical sight so that it aims at the point where test shots strike the target—which is the goal of sighting-in. The adjust-to-strikepoint method, however, has disadvantages. Unlike the measure-and-adjust method, the adjust-to-strikepoint method must be used with a boresighting, laser device, or sight-to-sight co-alignment aiming tool, each of which have limitations. The adjust-to-strikepoint method, moreover, cannot be used with a collimator aiming tool. The four aiming tools will be discussed in detail later. Overall, the adjust-to-strikepoint aimpoint-correction method is significantly more efficient than the measure-and-adjust method. There is no need to measure the amount of aiming error thereby negating the need for tape measures or graduated targets. If the shooter is on a firing range with other shooters and can see the bullet hole, there is no need to ask the other shooters to cease fire in order to safely walk to the target to make measurements. Furthermore, no mathematical computations are necessary because a shooter need not know the distance that each elevation and/or lateral adjustment moves the aimpoint at that distance, which may not be as the manufacturer states. These advantages remove many potential sources of error; thereby saving time, ammunition, and frustration.

Although the four aiming tools are generally reliable, they suffer from a number of deficiencies that can produce significant aiming errors. Therefore, most shooters first use them to help sight-in at a relatively short distance, for instance, 25 yards. Completing the sighting in process at 25 yards using live fire ensures that test shots fired at a target at a longer distance will be on paper. That longer distance is herein referred to as the "zero distance." The zero distance is chosen by the shooter for specific use, such as 100 yards to hunt whitetail deer or 200 yards or more to hunt antelope or elk. A rifle sighted-in at the zero distance is said to be zeroed. Gravity begins to pull a bullet downward as soon as it leaves the barrel; therefore, to achieve a zero at, for example, 200 yards, the barrel of a rifle must point up relative to the line-of-sight. The line-of-sight, or center line, of most riflescopes averages about 1.5 inches above the bore of the barrel. The upward cant of the barrel causes a bullet to first rise relative to a riflescope's line of sight, reach an apex, and then fall through the line-sight at exactly the zero distance. Bullets fired from most modern high-powered rifles that are zeroed for a significant distance rise through a riflescope's line of sight before or after 25 yards. A shooter may elect to set the aimpoint of the riflescope above or below the strikepoint of a test bullet on a target positioned at 25 yards so that a test bullet will fall down to the aimpoint on a target positioned at the zero distance, how far above or below can be determined from trajectory tables found in books or on the Internet. This vertical aimpoint offset is herein referred to as "target to zero-distance aimpoint compensation" or TZDAC. Using TZDAC at 25 yards helps ensure that test bullets fired at a target positioned at the zero distance will strike close to the aimpoint. However, doing so should never be relied on to yield satisfactory results. Trajectory tables are commonly based on both live fire tests made by factory marksmen and computed trajectories, which yield good but not perfect results. More importantly, the factory marksmen may have used a rifle that differs significantly from that used by the current shooter, including length and condition of the barrel. Differences in altitude and performance of ammunition made by different manufacturers can also cause the trajectory of tests bullets to differ from that shown on trajectory tables. In addition, any aimpoint errors made at 25 yards will be magnified at the longer distances. For these reasons, the most prudent shooters fire test shots at the zero distance and make the necessary aimpoint corrections. Other shooters use live fire results and TZDAC at 100 yards as an acceptable means of ensuring a satisfactory zero at a longer distance, say 200 yards. They set the strikepoint of test bullets 2-3 inches higher than the aimpoint at 100 yards knowing from the trajectory tables that the bullets will drop 2-3 inches (down to the line-of-sight) over the next 100 yards. One bullet that rises very close to 1.5 inches (i.e., to the line of sight of the riflescope) at 25 yards, and which falls through the line-of-sight at 200 yards is the popular 0.300 Savage, 150-grain pointed soft point Core-Lokt made by Remington Arms Company. In this document, for reasons of simplicity, it is assumed that the rifle being sighted in fires that cartridge, and that the first test shots are at a target 25 yards away and that the zero distance is 200 yards. Therefore, any aimpoint-corrections at those distances can be made to the strikepoint of the test bullets and use of TZDAC is unnecessary.

Boresighting Use of the four aiming tools for sighting-in, including checking that the optical sights have maintained their zero, is now described. The first aiming tool, boresighting, works with rifles and other firearms that allow a shooter to aim with the bore by looking through it from the breech end. Firearm types that allow this are those with break open, falling block, bolt actions, and muzzleloaders with removable breech plugs. Firearm types that preclude looking through the bore from the breech end include those with semi-automatic, pump, and lever actions. In those cases, a device that incorporates a right-angle prism or small mirror set at a 45-degree angle can be fitted into the action to provide a view down the bore from the top or side of the action. The bore is aimed at a target, usually 25 yards away. Then, the rifle is steadied and the optical sight is adjusted until it also aims at the target, all the while ensuring that the bore remains aimed at the target. The initial static stage of the sighting-in process is now complete and the live-fire stages begin. Using a rifle rest and/or sandbags to ensure accuracy, a test shot is fired at the target using the optical sight. The probability of getting on paper at this short distance is very high; however, it is also probable the test bullet will miss the aimpoint by some measure. Thus, a shooter can then use either the measure-and-adjust method or the adjust-to-strikepoint method to remove the aiming error. To use the preferred adjust-to-strikepoint method, the bore is aimed at the target and the rifle is steadied. Then the optical sight is adjusted to aim at the strikepoint of the test bullet, while ensuring that the bore remains aimed at the target. Then another test shot is fired to ensure that the bullet hits the aimpoint or very close to it.

The sighting-in process is usually completed by carefully firing three shots at a target at the zero distance and marking the centerpoint of the shot-group. If the zero distance is more than one hundred yards and the centerpoint of the shot-group is relatively close to the aimpoint, a shooter can use the measure-and-adjust method to remove the aiming error. Boresighting is too imprecise to use the adjust-to-strikepoint method for final zero, especially if the firearm has a large diameter bore such as muzzle loaders and shotguns. If all goes well, the sighting-in process is now complete.

To later check that the optical sight has retained its zero, a shooter notes the position of the aimpoint of the bore relative to the aimpoint of the optical sight on a target at the zero or other distance. Thereafter, he/she need only check that the aimpoints of the bore and the optical sight retain that spatial relationship at that distance. Because boresighting can be relatively imprecise, especially with large bore firearms, this method can reliably detect only moderate to gross changes in the aimpoint of the optical sight. Boresighting has other disadvantages. As previously noted, right-angle prisms and mirrors must be used with some types of firearms and these devices add cost and require aiming from the side or top, which is unnatural and can be difficult for some shooters.

Collimators The second aiming tool uses an optical collimator as the key component. A collimator is comprised of a short tube containing a convex lens at one end and a small opening at the other viewing end, which is at the focus length of the lens. Collimators produce a beam of parallel light rays that appear to emanate from a point an infinite distance away. A grid incorporated into a collimator can be seen only when looking straight at the viewing end of a collimator. Most collimators are held upright by an extendable metal rod, the bottom portion of which connects to a stud at a right angle. A shooter snugly inserts the stud into the muzzle and then rotates the collimator assembly around the axis of the stud and extends the rod, if necessary, until the collimator stands squarely in front of the optical sight. Once this is completed, the grid of the collimator will appear centered in the ocular lens of the optical sight. Instead of muzzle studs and extendable rods, some manufacturers mount the collimator on the top of a flat-faced plastic arm that has two thin magnets embedded along its length. The magnetic arm is positioned vertically on the muzzle of the rifle and then slid up or down on the muzzle until the collimator stands squarely before the optical sight. After a collimator is correctly positioned, the optical sight is adjusted so that it aims at the center point of the grid. The collimator is then removed, and the optical sight is used to fire one or more test shots at a target 25 yards away. The aimpoint is then corrected using the measure-and-adjust method. The more efficient adjust-to-strikepoint method cannot be used because it requires aiming at the target with the aiming tool, which is impossible with a collimator.

To finish sighting-in, three or more test shots are fired at the target at the zero distance and the centerpoint of the shot group is marked. The measure-and-adjust method can then be used again to make any necessary corrections to the aimpoint of the optical sight at that distance.

After the optical sight is zeroed, a shooter can take certain steps that will enable him/her to later check that the optical sight has retained its zero. To do so, a shooter positions the collimator on the muzzle again and notes the optical sight's aimpoint on the grid on the collimator. Thereafter, he/she can mount the collimator on the barrel to check if the optical sight still aims at the same point on the grid. Unfortunately, the aimpoint seldom falls on a vertical or horizontal line gridline, much less an intersection of such and, therefore, one must estimate when trying to determine the location of the original aimpoint on the grid and when trying to return to it, which leads to error. Collimator aiming tools have a number of other disadvantages. Sizing is especially a problem. Manufacturers of collimators that use studs that fit into the muzzle must supply a significant number of different sizes to match different caliber barrels. To get around this problem, some manufacturers use expandable arbors or other sizing devices. Proper positioning of the collimator can also be a problem.

Collimators should always be positioned vertically. To do so, most manufacturers recommend that the collimator be adjusted until the horizontal and vertical lines on the grid are parallel to the horizontal and vertical wires on the reticle of the optical sight; however, this is impossible with optical sights that use dot rather than crosshair reticles. The magnets used on some collimators can also cause problems. Some hunters carry collimators with magnetic arms in the field and these should be kept well away from compasses. Finally, the collimators must be significantly precise, which makes them relatively expensive.

Lasers A third aiming tool uses lasers devices, of which a number of sub-types exist. One sub-type fits all the electronic components into a cartridge that fits into the chamber of the firearm. Closing the action of the firearm turns on the laser, which then projects its beam through the bore. A second sub-type consists of a casing that is inserted into the chamber of the firearm; however, the power supply and other electronics are contained in an external housing connected to the casing by wires. Some manufacturers of this latter type laser aiming tool include a short cylinder with sizing devices that is inserted into the muzzle. A hole that runs lengthwise through the cylinder helps align the laser beam by allowing only that part of the laser beam that is centered to pass while blocking the rest. A third sub-type laser aiming tool fits all the components into housings shaped like disks or cylinders with a stud projecting from the back. The stud is aligned back-to-back with the laser. A shooter inserts the stud into the muzzle of the firearm and turns on the laser which projects its beam in a direction directly opposite that of the stud or muzzle. Some manufacturers include a magnet within the stud or around the base of the stud where it extends from the housing to pull the stud or housing against the crown of the muzzle. This prevents the housing from canting downward due to its weight. A fourth sub-type uses only a super strong magnet to hold the housing to the muzzle; no stud is required.

To use any of the laser aiming tools, the laser cartridge or casings are inserted into the chamber of the firearm, or the devices are mounted in or on the muzzle. The firearm is moved until the laser spot is on a target at a distance at which the spot can easily be seen, usually 25 yards or less in direct sunlight. The optical sight is then adjusted until it aims at the laser spot. There is no need to steady the rifle because the laser spot can be seen through the optical sight. The laser device is then removed, a test shot is fired at the target, and the adjust-to-strikepoint method is then preferably used to remove the aiming error. To do so, the laser device is mounted on the rifle again, and the laser spot is held on the target while the optical sight is adjusted to aim at the strikepoint of the test bullet. The laser device is removed again, a test shot is fired, and the necessary aimpoint corrections are made. To finish sighting-in, three or more test shots are fired at a target positioned at the zero distance and the center point of the shot group is marked. In normal daylight, a shooter probably will not be able to see the laser spot on the target, so he/she must use the measure-and-adjust method to remove the aiming error. Assuming all goes well, the sighting-in process will be complete.

To later check that the firearm's optical sight has maintained its zero, the laser device is mounted in/on the rifle again and aimed at a target positioned at a distance at which the laser spot can easily be seen under almost all lighting conditions, usually no more than 25 yards. The position of the laser spot relative to the aimpoint of the optical sight is then noted. Thereafter, a shooter can check that the optical sight has maintained its zero by checking that its aimpoint retains its position relative to the laser spot on a target positioned at that distance.

Laser aiming tools have a number of disadvantages. No cartridge lasers exist for the popular 22-caliber and 17-caliber magnum cartridges because the electrical components cannot be fitted into such small containers. In addition, manufacturers must provide matching laser cartridges for bullets of different shapes and sizes. Some manufacturers of laser cartridges fit all the electronics components into a single cartridge of the smallest size they provide, but the cartridge can be fitted with sleeves to give it size and shape of other larger bullets. Muzzle-aligned laser boresighters also have sizing problems. To ensure a good fit for different size bores, some manufacturers provide matching studs while others provide expandable arbors, magnets within arbors, tapered self-centering bushings, and other devices. All of the sizing solutions add cost and are inconvenient. The magnets used with some of the devices can also cause problems. Magnets used with housings, whether alone or with a stud, can cause the housing to tilt and, therefore, send the laser beam off line. This can occur if a stud does not fit snugly in the muzzle or if the muzzle crown has been damaged or is otherwise not at perfect right angles to the axis of the bore. Safety is of special concern with laser devices that fit into the muzzle. These devices must be removed before firing a test shot since not doing so can damage the firearm and even cause severe injury or death. Muzzle-mounted disk-shaped lasers and optical collimators give shooters a second chance to remove the devices because it is obvious to shooters that the devices are still attached when they aim through the optical sight to take a test shot. Unfortunately, this is not the case with some of the small cylindrical laser aiming tools that fit into the muzzle, especially when they are concealed by hooded front sights. In addition, the electronic components; sizing factors, and the necessary precision in manufacturing all contribute to the relatively high initial cost of laser aiming tools. There is also the cost and inconvenience of replacing batteries. A final disadvantage of laser aiming tools is the limit on usable distances caused by inability to see the laser spot in bright light. A laser spot can be seen up to 500 feet indoors or outside in early morning or late evening on dark cloudy days, but only to about 75 feet outside in normal daylight and even less in bright sunlight. Shades can be placed over targets on bright days to make the spot more visible, but this adds hassle. Some manufacturers provide reflective targets and/or laser enhancement glasses to increase the visibility of the laser spot, but this adds cost. Riflescopes help a shooter to see the laser spot relative to their power of magnification, but holographic and most reflex sights do not magnify the image.

Finally, the three aiming tools described above, i.e., boresighting, collimators, and laser devices, suffer from one additional disadvantage during their initial static use: all are based on the emanation of a straight line. As such, none of the three take into direct account the actual flightpath of a bullet fired from the firearm being sighted in. Gravity, air resistance, powder type and weight, bullet shape and weight, barrel length, and other factors affect a bullet such that its flightpath is not straight, but parabolic—the exact form of which is determined by the interplay of the above factors. In addition, bullet type and weight, powder type and weight, rate of twist, bore tolerance, barrel stiffness, fit of the barrel and other metal parts onto the stock, and other factors cause various degrees of so-called "muzzle whip." Muzzle whip and recoil occur together. The effects of both combine to "throw" a bullet off line mostly in a vertical direction; however, there is usually some lateral throw as well. All of the above disadvantages, mutual or specific, explain why most prudent shooters consider the three aiming tools generally suitable only for getting "on paper" first at a relatively short distance, e.g., 25 yards, and then making the necessary aiming corrections before progressing to a target farther away.

SIGHT-TO-SIGHT CO-ALIGNMENT The fourth aiming tool is sight-to-sight co-alignment, of which a number of sub-types exist. One sub-type requires that a riflescope be mounted on see-through mounts (or the much less common side mounts), and that the rifle be equipped with open sights. See-through riflescope mounts enable one to either use the riflescope or the open sights, the latter by looking under the riflescope through a window in the scope mounts.

Using see-through mounts to co-align the aimpoint of a riflescope with that of open sights that are known to be well-zeroed is simple. First, the open sights are aimed at a target at the zero distance. Then, the rifle is steadied and the riflescope is adjusted to aim at the same point on the target as the open sights. Any test shots fired thereafter using the riflescope can be expected to hit close to the aimpoint of the open sights at the zero distance. However, to finish sighting-in, a shooter should still fire three or more test shots at the target using the riflescope. A shooter can aim better using a riflescope than with open sights, especially if he/she is older or has impaired vision. Therefore, the centerpoint of a three-shot group acquired with the riflescope may differ somewhat from that acquired with the open sights, and some tweaking of the riflescope's aimpoint may be in order.

Sight-to-sight co-alignment has a number of other advantages over the other aiming tools. The method is highly specific to the rifle being sighted-in because it co-aligns the aimpoint of the riflescope to the aimpoint of the open sights that were sighted-in by live-fire at the zero distance. This fact negates the need to sight-in at a short distance first, thereby saving time and ammunition. The sight-to-sight co-alignment method is accurate and the results are highly repeatable. Furthermore, the efficient adjust-to-strikepoint aimpoint-correction method works well with sight-to-sight co-alignment. Checking that the riflescope and the open sights remain co-aligned as a means of determining whether one or the other is out of adjustment is fast and simple. The rifle is steadied and the riflescope and the opens sights are checked to determine if they remain aimed at the same point at the zero distance. Actions do not have to be opened, bolts do not have to be removed, collimators or laser boresighters do not have to be positioned on the rifle, and notes on the spatial relationship of the aimpoints of the riflescope and other aiming tools on a target need not be consulted. A shooter need only remember the zero distance to check that the elevation setting is correct. If the riflescope is still zeroed, then the lateral setting will be correct at any distance. Sight-to-sight co-alignment using see-through mounts is also relatively inexpensive; requiring only the purchase of the mounts, but most shooters buy see-though mounts so that they can use the open sights as backup, and so that cost is spread out.

Unfortunately, see-through mounts have a number of disadvantages. In order to allow a shooter to see under the riflescope, see-through mounts must elevate riflescopes significantly more than regular mounts. The disadvantages of the added height include: (a) riflescopes are more likely to be damaged or knocked out of adjustment because their added height increases the chances that they will be knocked about and also because the added height of the riflescopes causes additional forces to be applied to their mounts, bases, and screws; (b) the height of the riflescope affects the balance of a rifle, making it feel "tippy", and, hence, more tiresome to carry and awkward to use; (c), the height of riflescopes require shooters to hold their heads higher than normal when sighting. This heads-up position can prevent shooters from getting a good "cheek-weld" on the comb of the stock which can cause delay and/or errors in aiming because of an unstable head position and/or parallax error. A shooter can always add a laced-on leather cheek rest to the comb of the stock, but this adds cost and weight and detracts from the aesthetics and the balance of the rifle; and (d) the height of the riflescope makes the rifle difficult or impossible to fit into some gun cases and scabbards. Finally, as stated previously, another and probably the most common reason shooters use see-through mounts is so they can use the open sights if their riflescopes become unusable. This presumption, however, does not always work as intended. For example, in snapshooting at running deer or elk, many hunters find that their shooting eye will go to the riflescope by force of habit, even when they consciously know it is unusable. And by the time they realize they can use the open sights, the opportunity for a shot is often gone. In addition, see-through mounts restrict the field-of-view around the open sights, which makes snapshooting all the more difficult. Instead, experienced hunters simply remove their optical sights if they become unusable so they can then use their open sights. For all the above reasons, most shooters disdain the use of see-through mounts and use regular low mounts instead.

Besides see-through mounts, two other sight-to-sight co-alignment systems exist. One system uses open sights mounted on the top of a riflescope. The rear sight is usually an aperture sight mounted on the top of the ocular bell and the front sight is a blade mounted on the top of the objective bell. These open sights have two primary disadvantages. First, most are non-adjustable, and, therefore, they rely on the mechanical mounting of the riflescope to ensure accuracy, an objective that meets with mixed results. Second, they are plagued by sighting errors because of their short sighting radius. Hence, most of these open sight systems are designed only as back-up sights suitable only for emergency use, such as in combat. One available example is the ACOG 4X32 riflescope, model TA01NSN, manufactured by TRIJICON. These systems can be used for sight-to-sight co-alignment, but only at relatively short distances.

The remaining sight-to-sight co-alignment system uses open sights in conjunction with non-magnifying optical sights, like the HOLOSIGHT made by BUSHNELL or the RD30 RED-DOT made by BSA. These optical sights incorporate a small, battery-powered laser that imposes a reticle, usually a red-dot, on a transparent glass plate within the sight. The open sights usually consist of a front blade sight that is mounted on the barrel in front of the optical sight and a rear aperture sight that is mounted behind the optical. Because the optical sight is non-magnifying, a shooter can use the open sights. The effect is like having two thin panes of transparent glass positioned between the rear aperture sight and the front blade sight. Normally, the shooter will use the optical sight, but when it is damaged or when the batteries lose power, the shooter can switch to the open sights. This dual-sight or "co-witness" system can be used for sight-to-sight co-alignment. However, two main disadvantages exist: (1) the system can only be used with non-magnifying optical sights, and (2) the view through the majority of these optical sights is above the line-of-sight of most open sights of normal height. However, the elevated sights on some military rifles like the M-16, the main U.S. military rifle, enable sight-to-sight co-alignment. There are two methods of mounting a non-magnifying optical sight on the M-16 rifle so that the open sights can also be used. One method uses a special mount that positions the optical sight in front of and somewhat below the rifle's carrying handle in line with and between the rear aperture sight (which is mounted on the rifle's carrying handle) and the elevated front sight. The other method is to mount the optical sight on a variation of the M-16 rifle that does not have a carrying handle. In this case, the optical sight is mounted over the receiver at a height which places it in line with and between the rear aperture sight and the elevated front sight. The rear aperture sights partially obstruct a shooter's view through the primary optical sight, but this problem can be solved by using a type of aperture sight that can be folded down, but these are costly. An elevated rear notch sight mounted in front of the optical sight could also be used in place of the rear aperture sight, but none are known to be available.

The sight-to-sight co-alignment method using see-through mounts or non-magnifying optical sights can also be used to zero open sights. For example, a shooter may adjust the aimpoint of a newly mounted optical sight to the aimpoint of the open sights, which he/she thinks are well zeroed—but are not. A test shot using the optical sight, may, for example, hit 5 inches from the aimpoint of a target positioned at 25 yards, which translates to an aimpoint error of 20 inches at 100 yards. This means that the open sights were not zeroed. Nevertheless, as long as the strikepoint of the test bullet is on paper, the adjust-to-strikepoint method can be preferably used to zero the optical sight. After the optical sight is zeroed, the shooter can then elect to use the sight-to-sight co-alignment method to correct the aimpoint of the open sights. To do so, the shooter steadies the rifle and then adjusts the aimpoint of the open sights to the aimpoint of the optical sight at the zero distance. This is, of course, the reverse of the usual use of the sight-to-sight co-alignment method. Zeroing open sights by this method offers definite advantages. Zeroing open sights using other methods can be difficult. Usually, only the rear open sights are adjustable, and most are crude devices that are difficult to adjust. Most have dovetail bases that fit into cutouts on the barrel. Lateral adjustments are usually made by placing a brass punch on the side of the dovetail base and tapping it with a hammer. This drives the rear sight right or left by force of impact. Elevation adjustments are usually made by loosening one or more set screws on the rear sight and moving it up or down on a ramp or in a slot. Often, these elevation and lateral adjustments yield too much or too little movement of the aimpoint, and adjustment markings on the sight, if any, are of little help. These deficiencies make the zeroing of open sights a trial-and-error process because a shooter cannot easily tell if he/she over corrected or under corrected or by what amount. This means that numerous test shots may be required before the open sights are zeroed. Using the aimpoint of an already zeroed riflescope as a reference, a shooter can easily tell if the open sights were moved in the correct direction and by the proper amount and, if not, to try again. Therefore, zeroing open sights by co-aligning their aimpoint to that of the aimpoint of a riflescope that is already zeroed can save much time, ammunition, and frustration.

One disadvantage common to all sight-to-sight co-alignment methods is that the firearm must be equipped with open sights. Some current firearm manufacturers of rifles include open sights, but some do not in order to reduce costs and because they expect the rifle to be equipped with optical sights, but this practice deprives a shooter of backup sights when the optical sights are rendered unusable. The practice by some current firearm manufacturers of not including open sights does not apply to rifled shotguns, muzzleloaders, and military firearms manufactured throughout the world. All in all, many tens of millions of such firearms are equipped with open sights.

There is thus a need for an apparatus and a method to sight-in that is safe, accurate, highly repeatable, useable under most lighting conditions, is efficient in its use of ammunition, and does not require batteries.

SUMMARY OF THE INVENTION

Practice shows that sight-to-sight co-alignment using riflescopes with see-through mounts or non-magnifying optical sights and open sights is one of the best means for sighting-in optical sights and for checking that the aimpoint is maintained. Unfortunately, see-through mounts elevate riflescopes significantly—which causes the numerous problems, and sight-to-sight co-alignment with most non-magnifying optical sights is possible only with elevated open sights, which are uncommon except on some military rifles. This invention remedies both situations by enabling sight-to-sight co-alignment with both magnifying or non-magnifying optical sights by mounting a see-through periscope upright in the gap between the front of an optical sight and a rear open sight (of the notch type or any of its variations) of normal height. Four unique mounts hold the periscope. Each mount positions the bottom mirror of the periscope at a height that captures an image of the rear notch sight and the front sight aimed at a target. The bottom mirror reflects that image to the top mirror, which is positioned above the highest part of the optical sight. The top mirror then reflects the image of the open sights across the top of the optical sight into the eye of the shooter. Because the periscope has no front or back panels, a window exists in front of the optical sight that enables a shooter to also use it to aim at the same target. In essence, the periscope enables a shooter holding a rifle in a natural position to easily alternate between aiming at the same target with the optical sight or the open sights, and to adjust the aimpoint of one to the other. Co-aligning the aimpoint of the optical sight to that of the open sights, which are already zeroed, ensures that a shooter's first test shot will hit the aimpoint or very close to it.

The four mounts enable the periscope to be used with a wide range of magnifying and non-magnifying optical sights of various shapes and sizes. Three of the mounts allow the periscope to be adjusted up or down in order to accommodate open sights of different heights while the length of the periscope is such as to position the top mirror above the highest part of an optical sight. A fourth mount holds the periscope in a fixed position for use on firearms equipped with standardized optical and open sights of set heights.

The method and apparatus of the invention may further be used to sight-in optical sights that are useable with all calibers of rifles and other firearms so long as the open sight requirements are met.

The method and apparatus of the invention also checks that the optical sight remains co-aligned with the open sights in order to check whether one sight is out of adjustment. In the majority of cases, the optical sight will be out of adjustment. When open sights are at fault, they are usually loose or bent, and this is easily checked.

The method and apparatus of the invention can also be used with the preferred adjust-to-strikepoint method to correct the aimpoint of optical sights.

The method and apparatus of the invention can also be used to sight-in open sights by co-aligning their aimpoint with that of optical sights that are already sighted-in, contrary to the prior art methods of sighting-in open sights.

The invention is a method and an apparatus for sighting-in that is safe, accurate, highly repeatable, useable under most lighting conditions, does not use batteries, and is efficient in terms of cost and amount of time and ammunition used.

The invention will further be understood by reference to the Drawing and its Figures herein, wherein like reference numbers refer to like parts throughout the Figures.

DETAILED DESCRIPTION OF THE INVENTION

Figure 1:
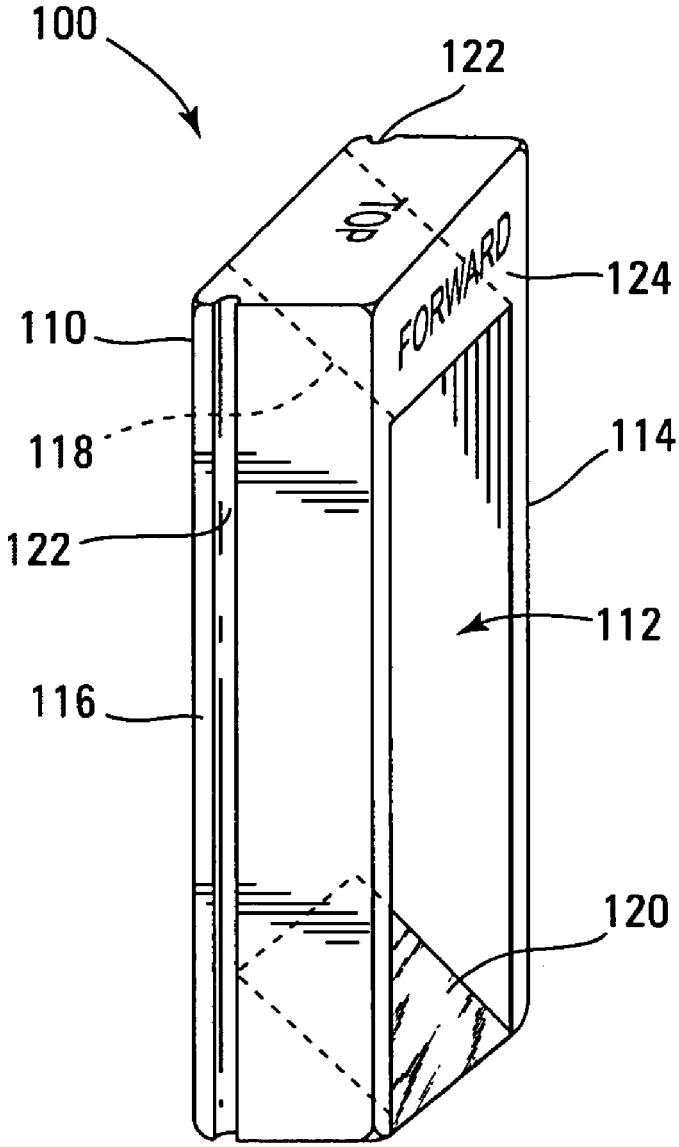
FIG. 1 is a perspective view of the see-through periscope in accordance with an embodiment of the invention.

With reference to FIG. 1, a see-through periscope 100 allows shooters to align the aimpoint of one sighting system, such as an optical sight, of which examples are riflescopes, holographic and reflex sights, to the aimpoint of another sighting system, such as open sights fitted on many rifles or other firearms, of which examples include shotguns, air rifles, and muzzle loaders. Different mounts for the periscope 100, of which four are presented herein, may be required to accommodate optical sights of a wide range of types, shapes, and sizes along with open sights of different heights.

Periscope 100 comprises a generally rectangular frame 110 into which a top mirror 118 and a bottom mirror 120 are mounted. Preferably periscope 100 has no front or back panels thereby creating a space, defined as a window 112, about 3 inches long between the surfaces of the top and bottom mirrors 118, 120 and ¾ inch wide between the two side panels 114, 116 of the periscope. The frame 110 of the periscope 100 may be made from polyvinyl chloride (PVC) plastic, wood, or any stiff and durable substance. Preferably, the two mirrors 118, 120 are first-surface (AKIA front-surface) mirrors with minimal distortion available from a number of manufacturers of optical components. Front-surface mirrors typically reflect about 97% of the light; therefore, the two mirrors 118, 120 together reflect just over 94% of the light. All eight corners of the frame 110 of the periscope 100 may be rounded to prevent the periscope 100 from scratching the optical coatings, if any, on the objective lens of an optical sight if they inadvertently come into contact with it. Each side panel 114, 116 of the periscope 100 may have a groove 122 for mating in the arcuate mount 210 as described below. The bottom of the periscope 100 may be scored in a cross-hatch pattern, and the top of the periscope 100 may be labeled "TOP" and the top facing panel 124 may be labeled "FORWARD" as shown.

Figure 2:
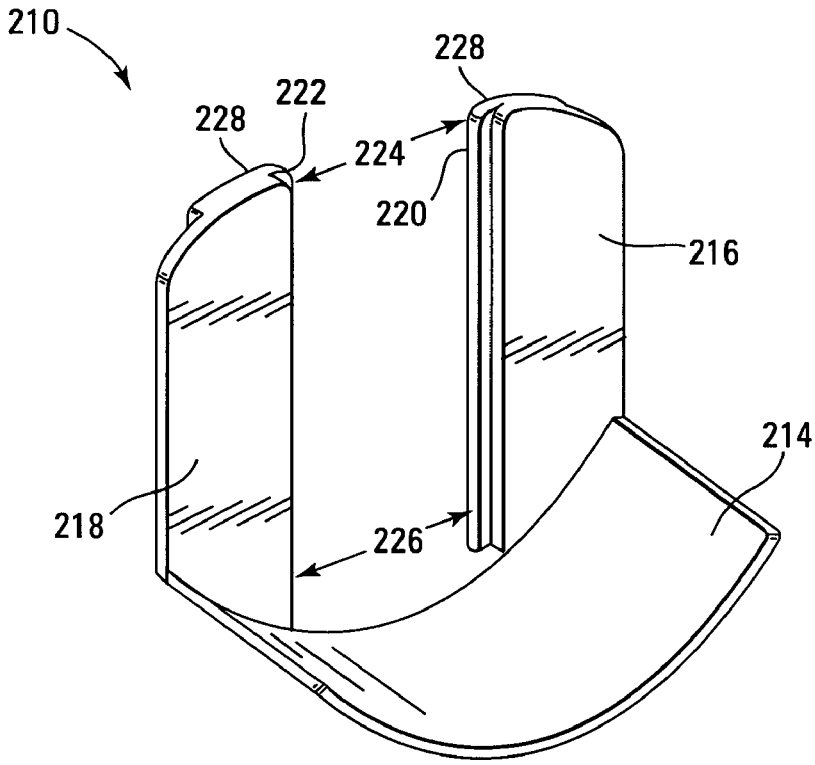
FIG. 2 is a perspective view of an embodiment of an arcuate mount for the see-through periscope in accordance with an embodiment of the invention.
Figure 3:
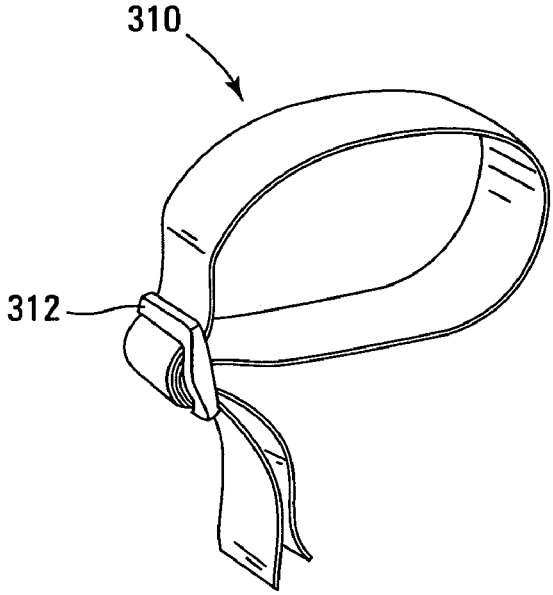
FIG. 3 is a perspective view of the holding strap that can be used with the arcuate mount to hold the see-through periscope onto the objective bell of a riflescope in accordance with an embodiment of the invention.

Arcuate Mount The periscope 100 may be mounted in an arcuate mount 210 in an arrangement as shown on FIG. 2. The arcuate mount 210 may be manufactured from a single piece of PVC plastic or other semi-rigid material approximately ⅛ inch thick except to where the thickness of the front panels 216, 218 increases at step-ups 228 to approximately ¼ inch to form the tongues 220, 222 and to offset them forward ⅛ inch. The length along the inner surface of the arcuate holding panel 214 is substantially equal to the distance covered by 100 degrees along the circumference of a circle having a diameter approximately 2.4 inches or 60 millimeters, i.e., the length along the inner surface may be approximately 2.1 inches long. The distance 226 between tongue 220 and tongue 222 near the bottom of the two front panels 216, 218 is substantially equal to the distance between the inner surfaces of the grooves 122 on the side panels 114, 116 of the periscope 100, but preferably the distance 224 narrows towards the top of the two front panels 216, 218 to snugly hold the periscope 100. Like the periscope 100, the top and bottom inner portions of the tongues 220, 222 on the front panels 216, 218 may be rounded as are all corners on the arcuate mount 210 to prevent scratching the optical coatings, if any, on the objective lens of an optical sight if they inadvertently come into contact with it. FIG. 3 illustrates a holding strap 310 preferably made of high-friction rubber that may be approximately 0.8 inch wide and 0.04 inch thick. The two ends of the strap 310 are joined at a buckle 312 to form an adjustable loop.

To assemble the periscope 100 into the arcuate mount 210, note the markings "TOP" and "FORWARD" on the top and top facing panel 124 of the periscope 100. Then, align the grooves 122 on the bottom of the periscope 100 with the tongues 220, 222 on the top of the front panels 216, 218 of the arcuate mount 210 and gently push the periscope 100 downward until its bottom portion extends slightly below the holding panel 214. The grooves 122 at the bottom of the periscope 100 are rounded as are the tongues 220, 222 at the top of the front panels 216, 218 to help guide the periscope 100 onto the mount. Because the distance between the grooves 122 on the side panels 114, 116 of the periscope 100 is slightly greater than the distance between the tongues 220, 222 on the top portion of front panels 216, 218 inserting the periscope 100 pushes the top portion of the front panels 216, 218 apart. The resultant spring-back action causes the front panels 216, 218, to squeeze the sides of the periscope 100. Once assembled, the back of the periscope 100 will be flush with the backs of the front panels 216, 218 of the arcuate mount 210 as shown on FIG. 4.

Figure 4:
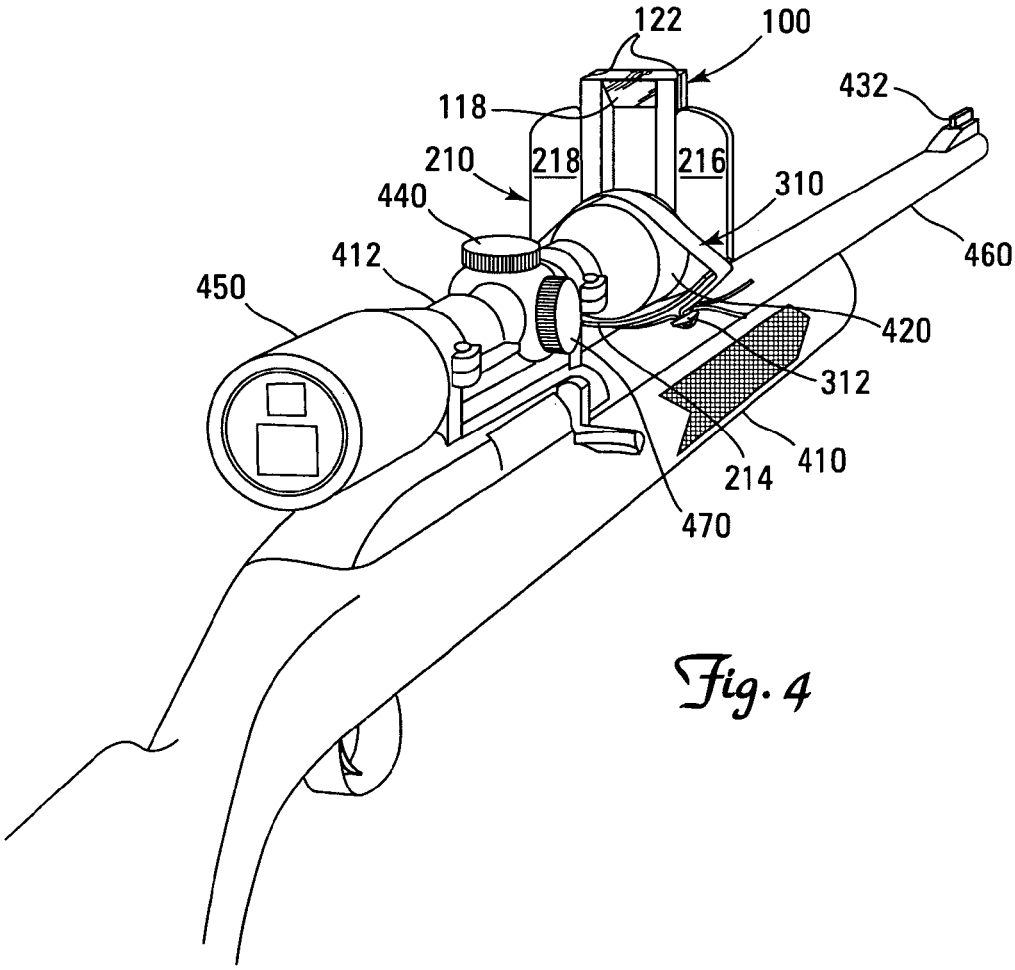
FIG. 4 is a perspective view of the see-through periscope fitted on the arcuate mount, which together are held onto the objective bell of a riflescope by the holding strap in accordance with an embodiment of the invention.
Figure 5:
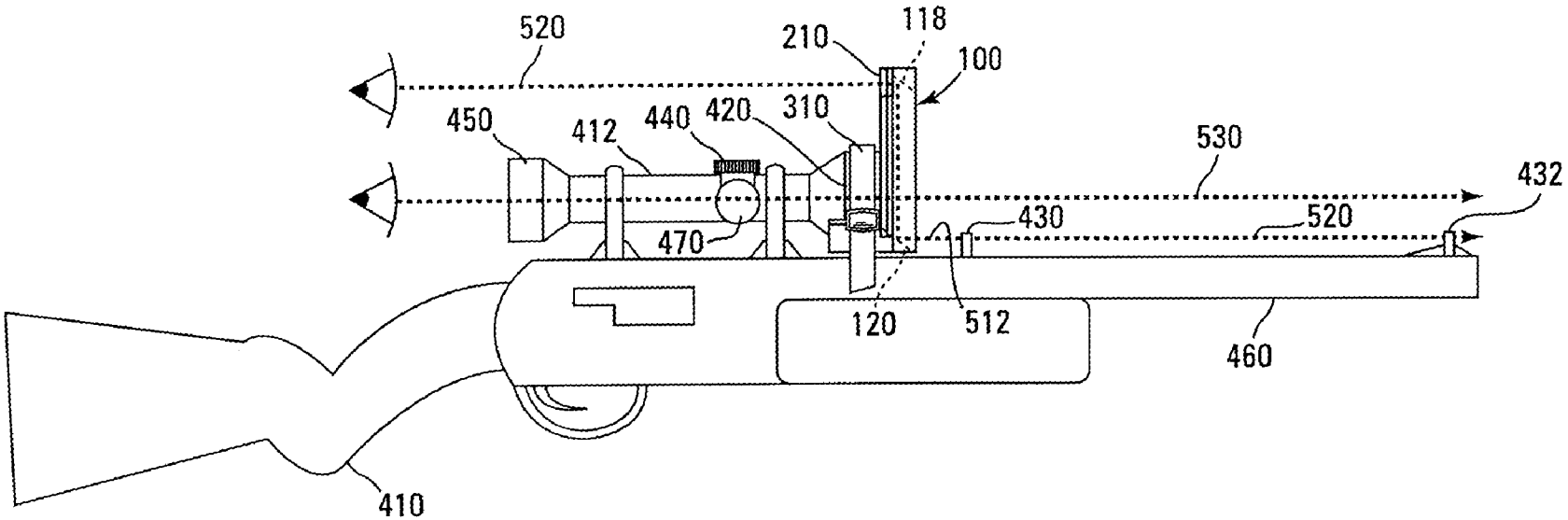
FIG. 5 is a side view of the see-through periscope fitted on the arcuate mount, which together are held onto the objective bell of a riflescope by the holding strap in accordance with an embodiment of the invention.

The holding strap 310 may be adjusted at the buckle 312 to the approximate length suitable for the diameter of the objective bell 420 of the riflescope 412, as best seen in FIG. 4, so that the holding strap 310 hugs the bottom around the holding panel 214 of the arcuate mount 210. The assembled periscope 100/mount 210/holding strap 310 combination can then be fitted on a riflescope 412, as shown in FIG. 4. To do so, slide the holding panel 214 of the arcuate mount 210 under the objective bell 420 of the riflescope 412 while pulling the strap 310 over the top of its objective bell 420. The strap 310 need apply only a few pounds of pulling force to pull the holding panel 214 of the arcuate mount 210 against the bottom of the objective bell 420. The holding strap 310 can be tightened or loosened at the buckle 312 if needed. The rubber holding strap 310 causes the front panels 216, 218 to apply an additional squeezing force to the periscope 100. The total squeezing force keeps the periscope 100 from moving up or down in the arcuate mounts 210 unless a small force is applied. FIGS. 4 and 5 are perspective and side views of the assembled periscope 100/mount 210/holding strap 310 combination mounted on the objective bell 420 of a riflescope 412 mounted on a rifle 410. As an alternate to the holding strap 310 and buckle 312, a number of elastic holding straps or loops of different lengths could be used with the arcuate mount 210 to accommodate objective bells 420 of different diameters. The current adjustable holding strap 310 is shown as a separate component, but it could be attached to the holding panel 214.

The length and curvature of the holding panel 214 ensures that the arcuate mount 210 can be used with riflescopes or other optical sights with objective bells 420 that have diameters ranging from approximately 1.0 inch to approximately 2.5 inches (In reality, objective bells with a 1-inch diameter are not bell-shaped, but are of the same diameter as the main tube of the riflescope; however, they are referred to as objective bells herein for reasons of simplicity). Of course, one of skill in the art will recognize that the length and curvature may need to be modified for riflescopes having objective bells with a larger or smaller diameter. The length and curvature of the holding panel 214 also dictates the width of the front panels 216, 218; as measured across the face of each of the panels, the width may be on the order of ¾ inch. The composition of the plastic (PVC) and its thickness of ⅛ inch, which steps up to ¼ inch to support and offset the tongues 220, 222 ⅛ inch forward, provides the front panels 216, 218 with sufficient strength and stiffness to counter any twisting force that might occur if the holding strap 310 is pulled tighter than it need be to hold the mount 210 securely on an objective bell 420. Weak front panels 216, 218 could flex and twist, and in turn, twist the periscope 100 and alter its line-of-sight, are undesirable. The ⅛ inch forward offset of the tongues 220, 222 on the mount 210 is the same distance as that from the back of the periscope 100 to its grooves 122. This ensures that when the periscope 100 is fitted into the mount 210, the back of the periscope 100 will be flush with the back of the front panels 216, 218 of the mount 210. Two other factors that counter any twisting of the periscope 100 are: (1) the tight fit of the tongues 220, 222 of the front panels 216, 218 in the grooves 122 on the side panels 114, 116 of the periscope 100, and especially the tight fit of the lower portion of the periscope 100 in the lower portion of the holding panel 210 where the back of the periscope 100 fits tight and flush against the front of the lowest portion of the holding panel 214. In addition, the length of the holding panel 210 is such that an imaginary horizontal line drawn from one end of the holding panel 214 to the other end passes through the center of an objective bell 420 one inch in diameter, as can be discerned from FIG. 6, to ensure that when a holding strap 310 of the appropriate length is pulled over an objective bell 420 as small as one inch diameter, the strap 310 will have sufficient angular force to pull the holding panel 214 firmly against the bottom of the objective bell 420.

Figure 6:
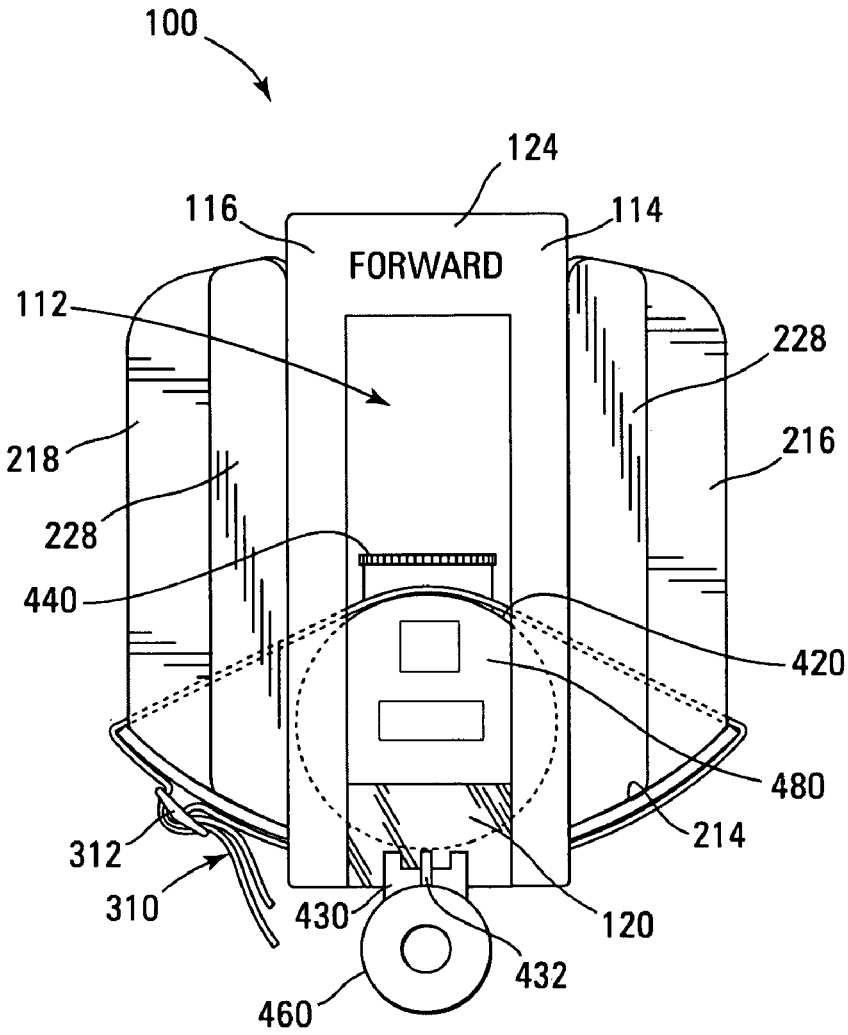
FIG. 6 is a front view of the see-through periscope fitted on the arcuate mount, which together are held onto a small diameter objective bell of a riflescope by the holding strap in accordance with an embodiment of the invention.
Figure 7:
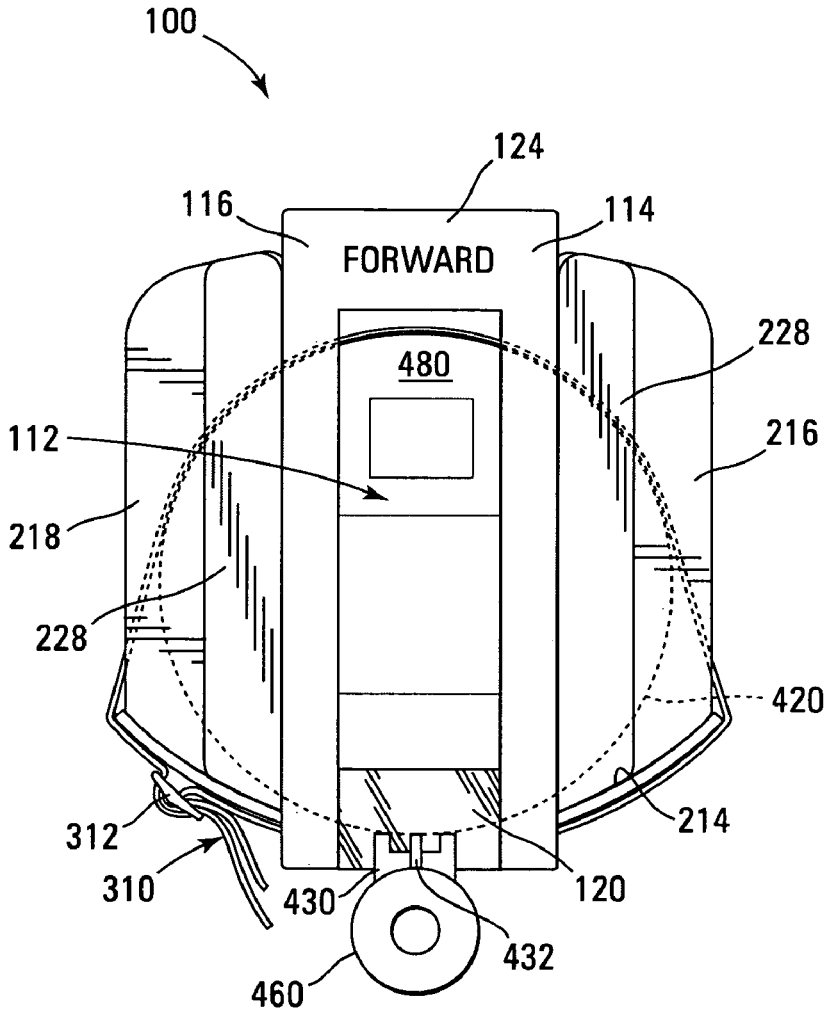
FIG. 7 is a front view of the see-through periscope fitted on the arcuate mount, which together are held onto a large diameter objective bell of a riflescope in accordance with an embodiment of the invention.

The assembled periscope 100 with its mount 210 must then be correctly positioned on the objective bell 420 of the riflescope 412. To do so, the ends of the holding panel 214 are rotated and pushed or pulled either right or left until the periscope 100 is vertical, i.e., plumb with gravity, and is laterally centered on the objective bell 420 of the riflescope 412 while ensuring that the back of the periscope 100 and the backs of the front panels 216, 218 fit flush against the rim of objective bell 420. The latter requirement helps ensure that the periscope 100 is vertical and that the front of the periscope 100 faces directly forward over the barrel 460 of the rifle 410 as in FIG. 5. FIGS. 6 and 7 are front views showing the assembled periscope 100/mount 210/holding strap 310 combination correctly mounted on two riflescopes 412, one with a smaller objective bell 420 as in FIG. 6 and the other with a larger objective bell 420 as in FIG. 7.

The use of periscope 100 is optimal when rifle 410 or other firearm is fitted with open sights 430, 432 and when a gap 512 as shown on FIG. 5 exists between the front of a riflescope 412 and the rear open sight 430 where the see-through periscope 100 and its mount 210 are preferably fitted. The gap 512 accommodates the thickness of the see-through periscope 100 so a preferred embodiment works especially well with short- or medium-length riflescopes 412 that have normal eye relief, and it is fortunate that most riflescopes or other optical sights mounted on firearms meet this requirement. Accordingly, the periscope 100 will not work with riflescopes or other optical sights that are so long or that have such long eye relief as to have the objective bell positioned closer than 0.5 inch to a rear open sight, or that have any portion positioned over, or in front of, the rear open sight.

Figure 8:
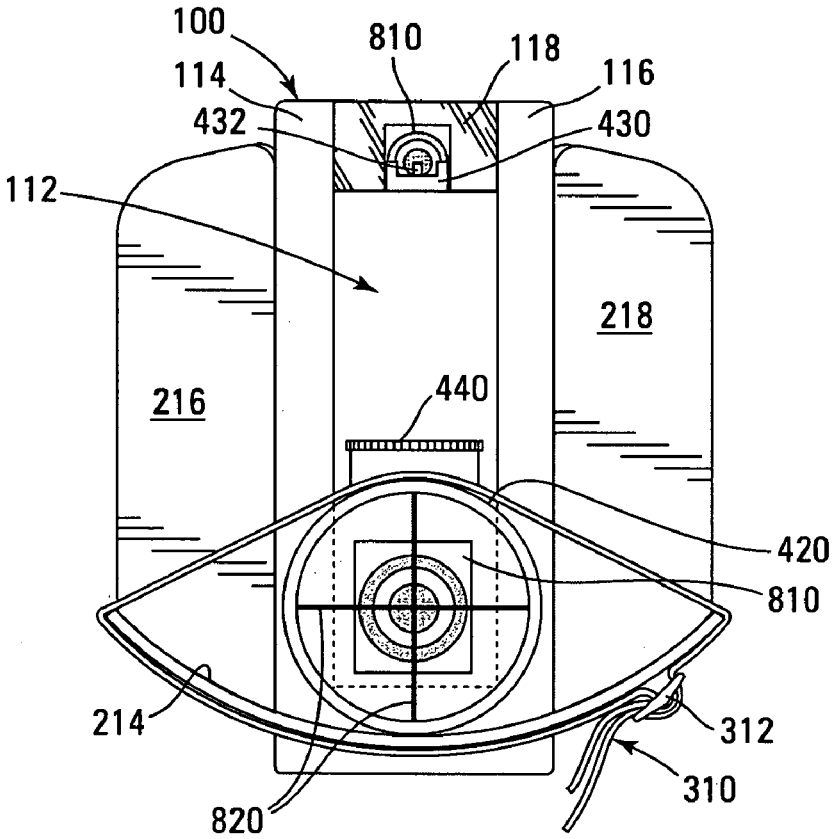
FIG. 8 is a shooter's view of a paper target (bullseye type) as seen both through the ocular lens of a riflescope and in the top mirror of the see-through periscope in accordance with an embodiment of the invention.

The assembled periscope 100/mount 210/holding strap 310 combination can then be used to co-align the aimpoint of a riflescope 412 or other optical sight to that of the open sights 430, 432 as shown on FIGS. 4 and 5. To co-align the aimpoint, the rifle 410 is first steadied, then the shooter looks across the top of the riflescope 412 at the top mirror 118 of the periscope 100 while sliding the periscope 100 up or down in the arcuate mount 210 until both the front sight 432 and rear sight 430 can be seen in the lower one third to one half of the top mirror 118, as shown on FIG. 8. One way to slide the periscope 100 up or down is to use one hand to grasp the end of one of the holding panel 214 to stabilize the arcuate mount 210 while grasping the top of the periscope 100 with the thumb and two fingers of the other hand and pulling or pushing or pulling the periscope 100 up or down. The ability to adjust the periscope 100 up or down is necessary to accommodate open sights 430, 432 of different heights. The length of the periscope 100 is dictated by the fact that its top mirror 118 must be positioned higher than the objective bells 420 and elevation adjustment turrets 440 of optical sights of a wide range of shapes and sizes in order to prevent obstruction of the top mirror 118 while the bottom mirror 120 is positioned low enough to capture a view of the open sights 430, 432 along optical path 520 as shown on FIGS. 5, 6, and 7.

Once the assembled periscope 100/mount 210/holding strap 310 combination is correctly positioned on the riflescope 412, a shooter looking over the top of the riflescope 412 while holding the rifle in a normal shooting position will be able to use either the open sights 430, 432 or the riflescope 412 by merely nodding his/her head. See FIG. 5 for the two positions of the eye. Also see FIG. 8 for a view of the target 810 aligned on the open sights 430 and 432 for one of the eye positions, and the second eye position is the view of the target 810 aligned on the riflescope crosshairs 820. To align the aimpoint of the riflescope 412 to the aimpoint of the open sights 430, 432, the shooter should preferably use a rifle rest to aim at a target 810 using the open sights 430, 432 as seen in the top mirror 118. The rifle 410 is then steadied. Being careful not to move the rifle 410, the person looks through the riflescope 412 to determine how much its aimpoint differs from that of the open sights 430, 432. Although some of the sides and lower portions of the objective lens 480 of the riflescope 412 will be obscured by the periscope 100 and the front panels 216, 218 of the arcuate mount 210 as shown on FIGS. 6, 7, and 8, the target 810 can be easily seen through the window 112 in the periscope 100. The aimpoint of the riflescope 412 is then adjusted by turning the screws in the vertical adjustment turret 440 and the lateral adjustment turret 470 so that the riflescope's 412 crosshairs 820, or other type of reticle, aims at the target 810 along line-of-sight 530 while ensuring that the open sights 430, 432 also remain aimed at the target along the optical path 520.

After co-aligning the aimpoint of the riflescope 412 to that of the open sights 430, 432, the assembled periscope 100/mount 210/holding strap 310 combination is removed. Then viewing through the riflescope 412 along line-of-sight 530, a test shot is fired at the target. If the open sights 430, 432 were well zeroed, the bullet should hit at or very close to the aimpoint of the riflescope 412. If the open sights 430, 432 were not well zeroed, then the assembled periscope 100/mount 210/holding strap 310 combination can be mounted on the riflescope 412 again, and the adjust-to-strikepoint method can preferably be used to correct the aiming error.

Alternate Periscope Mounts

Figure 9:
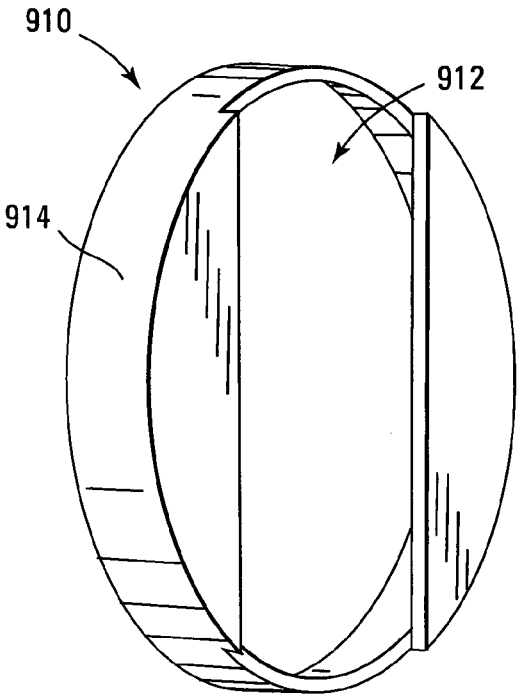
FIG. 9 is a perspective view of the non-adjustable lens-cap mount that can be used to support the see-through periscope on a riflescope in accordance with an embodiment of the invention.
Figure 11:
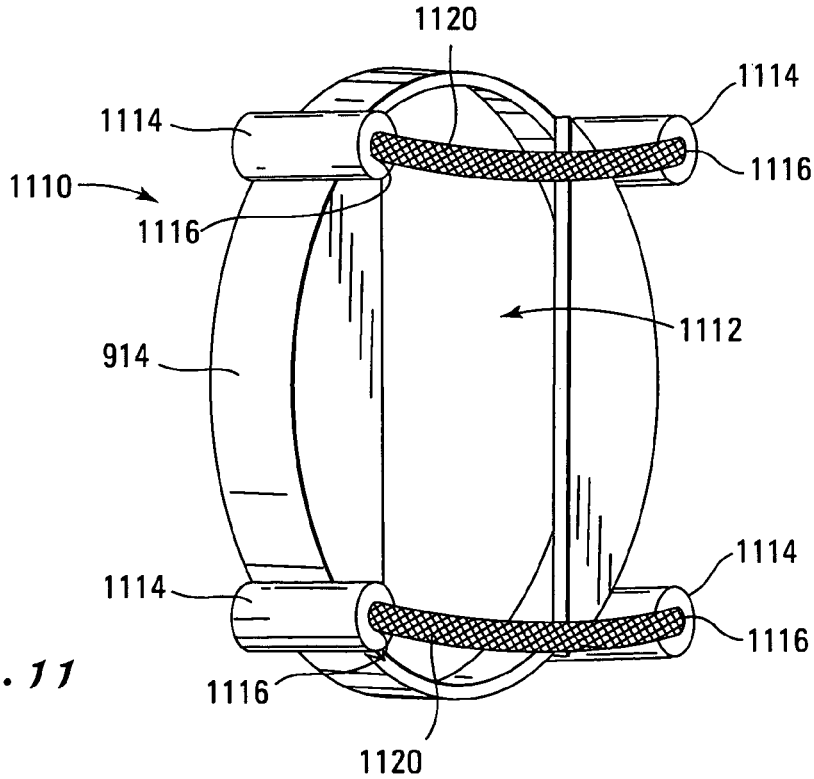
FIG. 11 is a perspective view of the adjustable lens cap mount that can be used to support the see-through periscope on a rifle in accordance with an embodiment of the invention.
Figure 13:
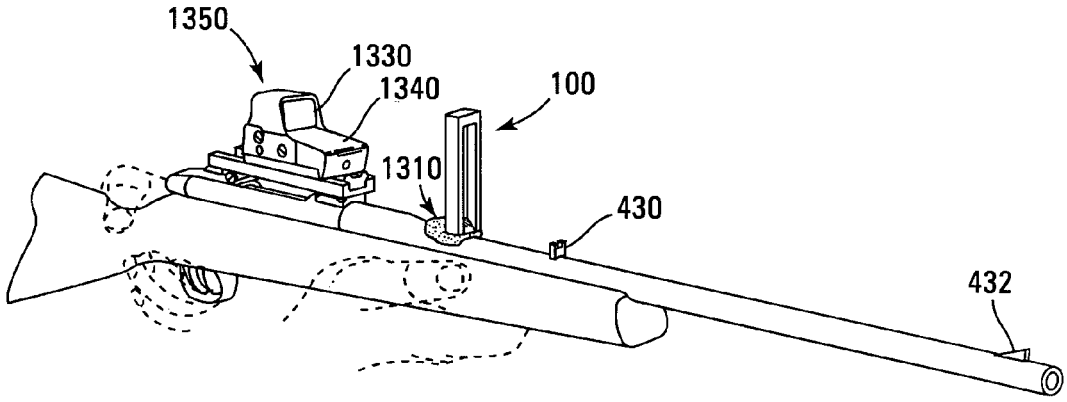
FIG. 13 is a perspective view of the see-through periscope positioned on a wad mount in front of a holographic sight in accordance with an embodiment of the invention.

Three alternate mounts, which are used in certain situations, are the non-adjustable lens-cap mount shown in FIG. 9, the adjustable lens-cap mount shown in FIG. 11, and the wad mount shown in FIG. 13.

Figure 10:
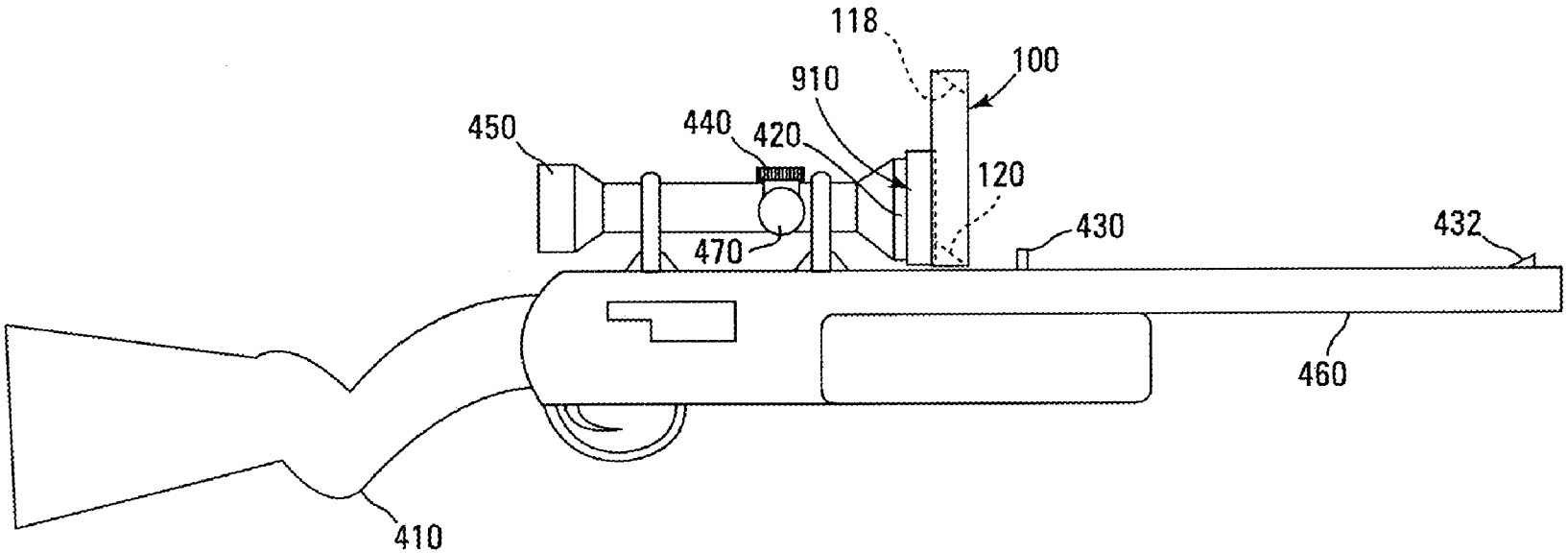
FIG. 10 is a side view of the see-through periscope fitted on a non-adjustable lens-cap mount, which together are mounted on the objective bell of a riflescope in accordance with an embodiment of the invention.

The non-adjustable lens-cap mount 910 shown in FIG. 9 is shaped like a protective lens cap fitted onto the rims of the objective bells of optical sights, such as the riflescope 412, except that it has a window 912 of the width of the periscope 100, cut out of its front from top to bottom. The mount 910 is also made of semi-flexible plastic. The periscope 100 used with the mount 910 is similar to that shown on FIG. 1 except that the grooves 122 may be absent. To assemble the periscope 100/mount 910, the mount 910 is fitted onto the rim of an objective bell 420 of a riflescope 412, and then the periscope 100 is fitted into the window 912 of the mount 910 with the top facing panel 124 of the periscope 100 marked "FORWARD" facing parallel to the barrel of the rifle. The tight fit holds the mount 910 in place on the rim of the objective bell 420 unless a few pounds of force are applied. The user then rotates the mount 910/periscope 100 combination on the rim of the objective bell 420 until the periscope 100 is vertical. The periscope 100 is then slid up or down in the window 912 until its bottom mirror 120 is at a height that captures an image of open sights 430, 432, that image is then reflected to the top mirror 118 for viewing, as shown in FIG. 10. The periscope 100 is then glued in place onto the mount 910. The aimpoint of the optical sight is co-aligned to the aimpoint of the open sights 430, 432 in the same manner as with the arcuate mount 210.

The periscope 100/non-adjustable mount 910 combination has a number of advantages. It can be used to speed up work in certain situations, including: (a) sighting-in large factory production runs of standard or same-type rifles and the like; and (b) sighting-in same-type optical sights that are mounted on a large number of same-type rifles equipped with same-type open sights, as occurs in police and military units. In addition, some individual users of non-standard rifles and sights may prefer a non-adjustable periscope 100/mount 910 combination for its ease-of-use features. It is useful for checking and correcting the aimpoints of optical sights in cold weather when manual dexterity is limited. And, it is simple and very inexpensive to manufacture. A disadvantage is that different diameter lens-cap mounts 910 are necessary to match objective bells 420 of different diameters.

The adjustable lens-cap mount 1110, shown in FIG. 11, allows the periscope 100 to be adjusted up or down to accommodate open sights of different heights. This adjustable lens-cap mount 1110 differs from the non-adjustable lens-cap mount 910 in that it has four integral turrets 1114 located around the rim of the mount 1110, two on either side of the window 1112 near its corners. A small hole 1116 extends the length of each turret 1114. A length of elastic cord 1120 extends across the window 1112 from one top turret 1114 to the other top turret 1114 and from one bottom turret 1114 to the other bottom turret 1114. The elastic cords 1120 extend through the holes 1116 and its ends are secured at the bottom of each of the turrets 1114 by knots, which being larger than the holes, are held in place there by the stretched cords 1120. One of skill in the art will appreciate that there are other methods of attaching elastic cords 1120 to the mount 1110.

Figure 12:
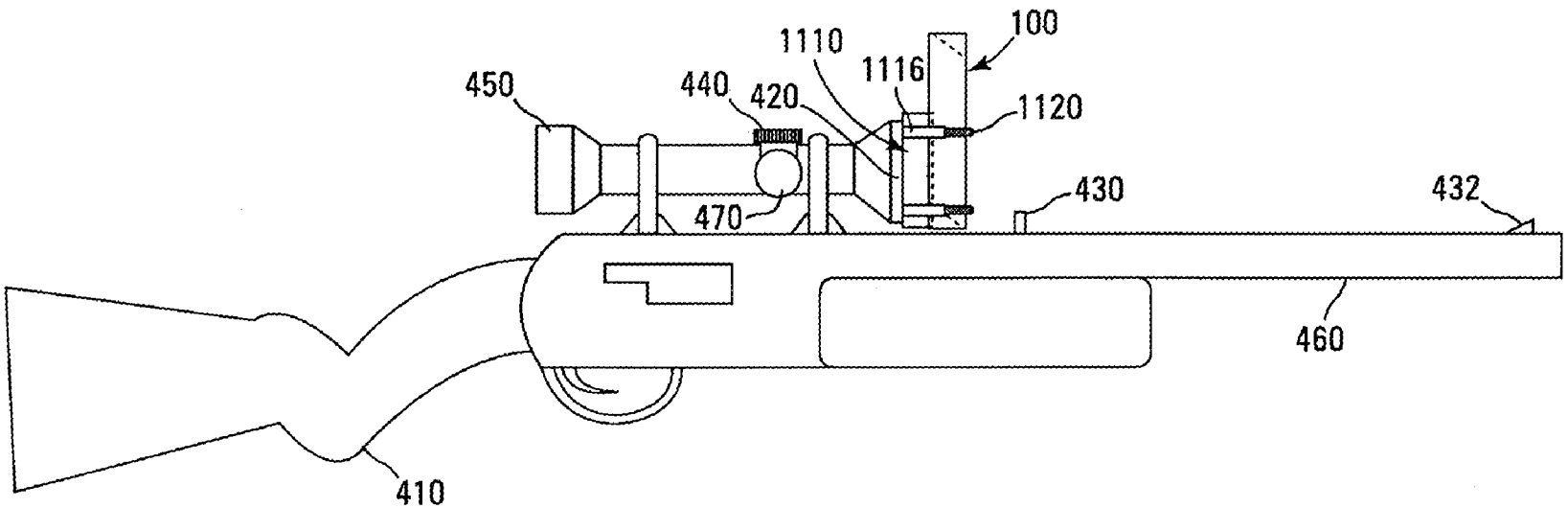
FIG. 12 is a side view of the see-through periscope fitted on an adjustable lens cap, which together are mounted on the objective bell of a riflescope in accordance with an embodiment of the invention.

The elastic cords 1120 are fit over the periscope 100 while sliding it down into the window 1112 of the mount 1110, continuing until the bottom of the periscope 100 extends just beyond the lower rim of the mount 1110. The cords 1120 are of a length and elasticity so that when they are stretched over the periscope 100, they will hold it in place in the window 1112 unless a small force is applied. The periscope 100/lens-cap mount 1110 combination is then fit over the rim of the objective bell 420 and rotated until the periscope 100 is vertical, as shown on FIG. 12. The tight fit of the rim 914 of the lens cap mount 1110 over the rim of the objective bell 420 holds the mount 1110 in place. The periscope 100 is then moved up/down until the bottom mirror 120 captures an image of the open sights as seen in the top mirror 118. Besides serving as anchors for the elastic cords, the turrets 1114 have another purpose. When the periscope 100 is pushed down, it can drag the top elastic cord 1120 down across the top of the window 1112 obstructing the view through it, and the opposite happens when the periscope 100 is pulled up. The length of the turrets 1114 decreases the length of the cords 1120 from where they bend at the top of the turrets to where they cross the periscope 100. Minimizing that distance minimizes the distance that the cords 1120 can be dragged by the periscope 100 without restricting the ability of the cords 1120 to hold the periscope in the window. The mount 1110 can be used for the same purposes and in the same manner as the arcuate mount 210. A disadvantage is that different diameter mounts 1110 must be provided to match objective bells of different diameters. An advantage is that the adjustable mount 1110/periscope 100 combination can be fitted onto an optical sight and aligned nearly as easily as the non-adjustable lens-cap mount 910.

There may be some conditions that preclude use of the arcuate and lens-cap mounts 210, 910, 1110. For example, the arcuate mount 210 cannot be used if the gap between the bottom of the objective bell 420 and the barrel 460 of a rifle 410 is less than the thickness of the holding panel 214 and holding strap 310. Nor can the arcuate mount 210 or either of the lens-cap mounts 910, 1110 be used if the objective bell 420 is fitted with a sunshade that has a rim that is other than vertical. Moreover, none of the mounts 210, 910, 1110 can be used with optical sights that do not have objective bells, such as the holographic sights made by BUSHNELL and others. In such cases, a wad mount 1310 supports the periscope 100 on a wad of reusable, malleable adhesive, such as poster tack or other suitable material, such as POSTER PUTTY available from HENKEL Company.

FIG. 13 shows the HOLOSIGHT 1350 made by BUSHNELL mounted on a rifle. The shape of the HOLOSIGHT 1350 precludes use of the other previously described periscope mounts 210, 910, 1110, in that there is no space under the objective rim 1330 to fit the holding panel 214 of the arcuate mount 210 or the rims 914 of the lens-cap mounts 910, 1110. In addition, the battery compartment 1340, which begins below and forward of the objective rim 1330, prevents mounting the periscope 100 in contact with the optical rim 1330, which itself is not vertical. To use the wad mount 1310, press a wad 1310 of putty onto the barrel in front of the battery compartment 1340. The periscope 100 is then pressed straight down onto the wad 1310. Doing so will cause the bottom of the periscope 100 to adhere to the wad 1310. The periscope 100, which is preferably scored on the bottom to help it stick to the wad 1310, stands upright like a candle stuck on its own wax. While looking at the top mirror 118 of the periscope 100, the periscope 100 is continually pressed down onto the wad 1310, and rotated laterally if necessary, until a view of the open sights 430, 432 occupies the bottom one third to one half of the top mirror 118. Then the aimpoint of the optical sight is co-aligned to the aimpoint of the open sights 430, 432 using the procedures described previously. The periscope 100 is easily removed by pulling it straight up and off the wad 1310. Most of the wad material will come off in one piece, and any that remains is easily wiped off. The wad mount 1310 works well under most conditions, but the periscope 100 is not held as securely as with the other mounts and wad materials can become too viscous to use in cold weather. The periscope 100 when used with the wad mount 1310 may begin to tip after a period of time due to the plasticity of the wad material, especially in hot weather, but the periscope is easily tipped up again and re-aligned. Tipping can be countered by reducing the weight of the periscope 100 by skeletonizing or making it out of lighter material After the optical sight is zeroed, the periscope 100 and any of its mounts 210, 910, 1110, and 1310 can be used to zero the open sights, if needed, by using the sight-to-sight co-alignment method as previously described.

The see-through periscope 100 and its mounts 210, 910, 1110, 1310 are not designed to be used during live fire and should be removed from a rifle prior to those events.

The distance between the side panels 114, 116 of the periscope 100 is about ¾ inch which allows the backs of the side panels 114, 116 of the periscope 100 to be seated against the rims of objective bells 420 of the smallest popular size of one inch as well as those that are larger. If the side panels 114, 116 were more than one inch apart, the periscope 100 would fit over objective bells of one-inch diameter. The holding panel 214 could be made less than 1.0 inch wide so that the arcuate mount 210 could be used on riflescopes that have their front mounting rings positioned closer than one inch to the rim of the objective bell 420. Periscopes 100 with wider windows could be used with optical sights with larger diameter objective bells 420. This and other features of the arcuate mount 210 could be changed to accommodate objective bells of larger or smaller diameters. The periscope 100 could also be lengthened, shortened, or narrowed for the same reason. For example, longer periscopes 100 could be used where the elevation adjustment turrets 620 on an optical sight are unusually high or where the diameters of the objective bells 420 of riflescopes are unusually large.

As shown on FIGS. 4 and 5, the arcuate mount 210 is attached to a riflescope 412 with the holding panel 214 on the bottom of the objective bell 420 and the holding strap 310 positioned on its top. The arcuate mount 210 can also be used with the holding panel 214 positioned on the top of the objective bell 420 and the holding strap 310 stretched across its bottom. In this case, the length of the front panels 216, 218 should be no more than 1.5 inches. This restriction in length is dictated by the fact that if low riflescope mounts are used, the barrel 460 of the rifle may lie as little as 0.5 inch below an objective bell 420 of one-inch diameter. If the front panels 216, 218 are longer than 1.5 inches they could contact the barrel 460 of the rifle and prevent proper positioning of the arcuate mount 210.

A thin coating or layer of high-friction latex, plastid, or similar material could be applied to the inner portion of the holding panel 214. The high-friction material would help steady the arcuate mount 210 on the objective bell 420 of the riflescope 412, but this would add cost and any advantage seems small. As it is, the friction and pulling force of the holding strap 310 seems sufficient.

The first-surface mirrors 118, 120 used with the periscope 100/mount 210 have good optical characteristics; however, they are more expensive and subject to scratching than alternatives. Mirrors with first-surfaces made of metals other than aluminum are also suitable. Ordinary second-surface mirrors made of glass with a silver backing are cheaper and more scratch resistant; however, they cast secondary reflections (AKA ghost images) into the eye of the shooter. Right-angle prisms made of plastic or glass could substitute for the first-surface mirrors 118, 120 since they do not cast secondary reflections and are relatively tough; however, they are more expensive. Glass mirrors and prisms also create sharp edges or pieces when broken.

An elastic cord (or two) extending from one (or both) side(s) of either of the lens-cap mounts 910, 1110 to one (or both) side(s) of a lens cap over the ocular bell 450 could be used to help hold either of the lens-cap mounts 910, 1110 in place on the objective bell 420. A circular window in the ocular lens cap enables use of the riflescope 412.

Instead of scoring the bottom of periscope 100 to help it stick to wad mount 1310, the hook side of a length of self-adhesive Velcro can be stuck on the bottom of the periscope 100. Pressing the periscope 100 onto the wad pushes the hooks into the wad mount 1310 and stabilizes the periscope 100.

In essence, the invention enables a shooter holding a rifle in a normal manner to alternately use either the optical sight or the open sights by a mere nod of his/her head. Doing so enables a shooter to sight-in an optical sight by co-aligning its aimpoint with that of previously zeroed open sights, or vice versa. The invention can also be used to help make aimpoint corrections and to check that the optical and open sights remain co-aligned; if not, one or the other sight is out of adjustment. The invention fulfills all of the above uses or goals at low cost, safely, and with efficient use of time and ammunition. Although the description above contains many details, these details should not be construed as limiting the scope of the periscope 100/mount 210/holding strap 310 combination or the lens cap mounts 910, 1110 or the wad mounts 1310, but as merely providing illustrations of some of the presently preferred embodiments of this invention. In addition to the examples given under "Alternate Embodiments" above, the invention with any of its mounts or in any of its mounts or embodiments could be used for purposes other than sighting-in firearms, such as enabling one to look into small enclosures. Thus the scope of the invention should be determined by the appended claims and their legal equivalents, rather than by the examples given.

What is claimed is:

1. A see-through periscope for sighting-in a firearm having one or more open sights and an optical sight, comprising:

(a) a rectangular frame creating a window having a length and a width, the window being a void between an upper inner side of the frame opposite to a lower inner side of the frame in a lengthwise dimension and between two inner sides of the window in widthwise dimension;

(b) a top reflector attached at a first angle on the upper inner side of the frame at a top of the window;

(c) a bottom reflector attached at a second angle on the lower inner side of the frame at a bottom of the window such that light rays, upon entering the window from a forward direction, reflect from the bottom reflector to the top reflector and emerge in an opposite direction;

(d) a removable mount into which the see-through periscope is adjustably mounted, the mount removably affixed to the firearm between the one or more open sights and the optical sight, and the bottom reflector colinear with the one or more open sights;

wherein the bottom reflector and the top reflector provide an image of the one or more open sights aimed at a target, and the window allows a unobstructed view of the target through the optical sight.

2. An arrangement usable to coalign one or more open sights of a firearm with an optical sight affixed thereon, a target being viewable through the optical sight, the arrangement comprising:

(a) a see-through periscope within a frame having an open space between a bottom reflector and a top reflector attached to the frame in a lengthwise direction and by sides of the frame in a widthwise direction and open in a direction perpendicular to the lengthwise and the widthwise direction, the bottom reflector and the top reflector mounted inside the frame at respective angles such that incoming light is reflected from the bottom reflector to the top reflector and emerges parallel to the incoming light; and (b) a removable periscope mount removably attached to the firearm between the one or more open sights and the optical sight; and the one or more open sights and an aimpoint on the target and the bottom reflector are colinear.

3. The arrangement of 2, further comprising the periscope mount with a curved lower surface forming an arc, and two grooved extensions extending upwards from the curved lower surface creating a space between the grooved extensions into which the see-through periscope is slidably mounted.

4. The arrangement of claim 3, further comprising a strap attachable to a curved outer surface of the the periscope mount and around an outer perimeter of an objective bell of the optical sight to secure the periscope mount onto the objective bell.

5. The arrangement of claim 2, further comprising a lens-cap periscope mount attachable to an objective bell of the optical sight, the lens-cap periscope mount having an opening into which the see-through periscope can be positioned and vertically adjusted.

6. The arrangement of claim 5, further comprising the lens-cap periscope mount having a plurality of elastic cords, one cord extensible across the opening and affixed to a perimeter of the lens-cap periscope mount towards the top and one cord extensible across the opening and affixed to the perimeter of the lens cap periscope mount towards the bottom, the elastic cords securing the see-through periscope in the opening.

7. The arrangement of claim 2, wherein the mount is a wad of putty into which the see-through periscope is pressed.

* * * * *